US011817066B1

(12) United States Patent
Guynes et al.

(10) Patent No.: US 11,817,066 B1
(45) Date of Patent: Nov. 14, 2023

(54) DISPLAY SCREEN MODE-BASED BRIGHTNESS SCALES

(71) Applicant: HEWLETT-PACKARD DEVELOPMENT COMPANY, L.P., Spring, TX (US)

(72) Inventors: Timothy P. Guynes, Spring, TX (US); Richard J. Krill, Spring, TX (US); Fu Teng Shih, Taipei (TW)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/866,754

(22) Filed: Jul. 18, 2022

(51) Int. Cl.
*G09G 5/10* (2006.01)

(52) U.S. Cl.
CPC ..... *G09G 5/10* (2013.01); *G09G 2320/066* (2013.01); *G09G 2320/0626* (2013.01); *G09G 2320/0666* (2013.01); *G09G 2330/021* (2013.01); *G09G 2354/00* (2013.01)

(58) Field of Classification Search
None
See application file for complete search history.

(56) References Cited

U.S. PATENT DOCUMENTS

| | | | |
|---|---|---|---|
| 5,675,364 | A | 10/1997 | Stedman et al. |
| 5,685,364 | A | 11/1997 | Harris |
| 5,881,300 | A | 3/1999 | Chen |
| 5,978,923 | A | 11/1999 | Kou |
| 6,493,002 | B1 | 12/2002 | Christensen |
| 2004/0029621 | A1 | 2/2004 | Karaoguz et al. |
| 2005/0068016 | A1 | 3/2005 | Hung |
| 2007/0045441 | A1 | 3/2007 | Ashworth et al. |
| 2007/0268397 | A1 | 11/2007 | Udono |
| 2008/0270809 | A1 | 10/2008 | Hoffer et al. |
| 2009/0024855 | A1 | 1/2009 | Kuan-Hong |
| 2010/0082414 | A1 | 4/2010 | Shimaya |
| 2010/0115296 | A1 | 5/2010 | Inoue et al. |
| 2012/0320280 | A1 | 12/2012 | Waites et al. |

(Continued)

FOREIGN PATENT DOCUMENTS

| | | | |
|---|---|---|---|
| CN | 101059671 | A | 10/2007 |
| CN | 102196204 | A | 9/2011 |

(Continued)

OTHER PUBLICATIONS

"Public Mode Setting Procedure (LC-52/60/70LE640U/C6400U, LC-80LE633U/844U)," (1st Edition), retrieved at https://manualzz.com/doc/987620/-4-public-mode-setting-procedure-lc, retrieved on Apr. 10, 2012, 8 pages.

"Screenshots of Windows 7, Help and Support, Keyboard Shortcuts," retrieved at https://www.aehost.net/downloads/Win7_KB_Shortcuts.pdf, retrieved on Jul. 12, 2012, 3 pages.

(Continued)

*Primary Examiner* — Andre L Matthews
(74) *Attorney, Agent, or Firm* — Quarles & Brady LLP

(57) ABSTRACT

In an example in accordance with the present disclosure, a display device is described. The display device includes a display screen to display content. The display device has a first mode and a second mode. A first mode brightness scale, which defines a range of available brightness values for the display screen, is different than a second mode brightness scale. The display device includes a display controller to select a brightness scale for the display device based on a current mode of the display device.

15 Claims, 5 Drawing Sheets

(56) References Cited

U.S. PATENT DOCUMENTS

| | | | | |
|---|---|---|---|---|
| 2015/0067373 | A1 | 3/2015 | So et al. | |
| 2015/0185971 | A1 | 7/2015 | Gomez et al. | |
| 2017/0048801 | A1 | 2/2017 | Choi et al. | |
| 2017/0263208 | A1* | 9/2017 | Imai | G09G 5/373 |
| 2020/0250800 | A1* | 8/2020 | Suzuki | G09G 5/10 |
| 2021/0103372 | A1* | 4/2021 | Scheffler | G06F 3/0488 |
| 2021/0303229 | A1* | 9/2021 | Otani | G06F 3/1204 |
| 2021/0390915 | A1* | 12/2021 | Park | G09G 5/10 |

FOREIGN PATENT DOCUMENTS

| | | | |
|---|---|---|---|
| CN | 102365616 | A | 2/2012 |
| CN | 104238718 | A | 12/2014 |
| EP | 0626633 | A1 | 11/1994 |
| GB | 2448722 | A | 10/2008 |
| WO | 2010/090646 | A1 | 8/2010 |
| WO | 2014/187341 | A1 | 11/2014 |

OTHER PUBLICATIONS

Adder Technology Ltd., "AdderView Matrix MP Installation and Use", retrieved at https://www.adder.com/sites/default/files/pdf/manuals/AdderViewMatrixMP.pdf, Oct. 2003, 80 pages.

Fujitsu Technology Solutions GmbH, "Operating Manual X23T-1, MHL", retrieved at https://www.manualslib.com/manual/1297505/Fujitsu-X23t-1-Mhl.html#manual, Sep. 2012, 42 pages.

Kishore, A., "Prevent Windows from Turning Off USB Devices", retrieved at https://helpdeskgeek.com/how-to/prevent-windows-from-powering-off-usb-device/, Oct. 3, 2009, 9 pages.

NEC, "User's Manual MultiSync X464UN MultiSync X464UNS MultiSync X464UNV MultiSync X554UN MultiSync X554UNS", retrieved at https://www.support.nec-display.com/dl_service/data/display_en/manual/x464un/X464UN_X464UNS-2_X464UNV_X554UN_X554UNS-2_X554UNV_manual_EN.pdf, Feb. 24, 2016, 55 pages.

Techview, "Service Manual for the Envision EN9410", retrieved at https://diagramas.diagramasde.com/otros2/Envision_EN9410.pdf, Feb. 18, 2005, Revision 1A, 48 pages.

* cited by examiner

DISPLAY SCREEN MODE-BASED BRIGHTNESS SCALES

BACKGROUND

Display devices present visual content to a user. Display devices may be coupled to computing devices, like desktop computers, which lack built-in displays. Display devices may be coupled to computing devices that have built-in displays such as laptop computers, tablet computing devices, and mobile computing devices like smartphones to provide additional display space. In other examples, a display device may be a stand-alone device that is not coupled to a computing device. For example, a display device may be a television to display television shows, streaming video, and so on.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
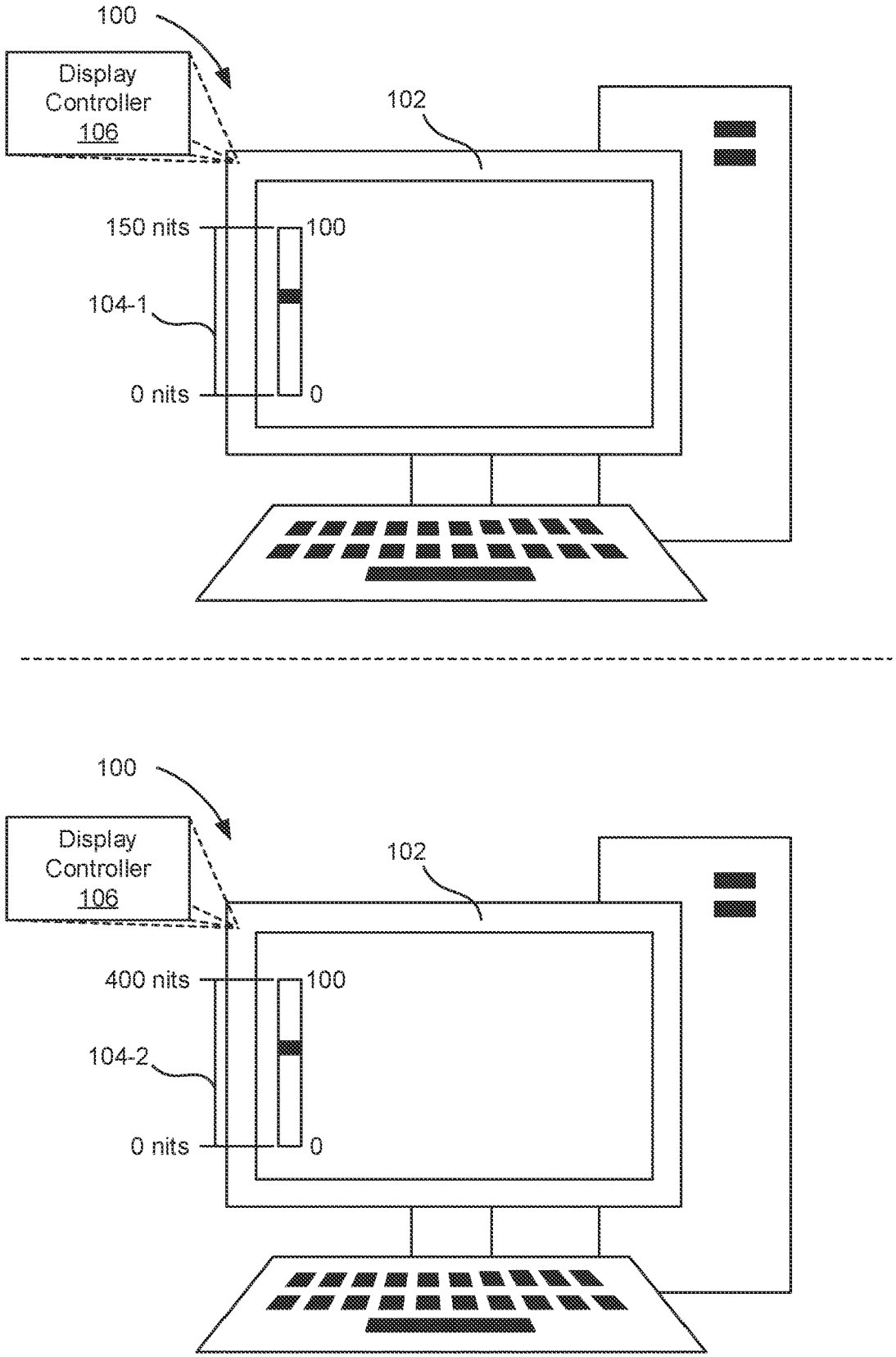
FIG. 1 is a diagram of a display device with mode-based brightness scales, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations that coincide with the description; however, the description is not limited to the examples and/or implementations provided in the drawings.

DETAILED DESCRIPTION

Computing devices are used by millions of people daily to carry out business, personal, and social operations and it is not uncommon for an individual to interact with multiple computing devices on a daily basis. Examples of computing devices include desktop computers, laptop computers, all-in-one devices, and gaming systems to name a few. Display devices coupled to these computing devices present visual information to a user.

In another example, a display device may not be coupled to a computing device, but may still present visual content to a user. For example, the display device may be a television, a mobile device such as a smartphone, or a tablet. While particular reference is made to particular display devices, the display device of the present specification may be of any variety of types.

In either example, a display device may include hardware components that are used to 1) present the content to the user and 2) provide additional functionalities. For example, a display device may include a wireless transceiver to connect to the internet to facilitate streaming video content directly to the display device. While particular reference is made to one hardware component of the display device, a display device includes other hardware components that may aid in the presentation of visual content to a user or expand the capabilities of the display device.

Each hardware component within the display device consumes power. As display devices add hardware components to increase functionality and capability, the overall power consumption of the display device also increases. One component that contributes to the overall power consumption of the display device is the backlight, or other light source, which illuminates a display screen. The brighter the display device, the greater the power consumption of the backlight of other light source. In fact, the backlight to the display device is the greatest consumer of power in the display device. Accordingly, reducing brightness of the display device has the greatest effect on overall power consumption of the display device.

Accordingly, to reduce the overall power consumption of the display device, a manufacturer may generate display devices with reduced brightness. As a particular example, governments or other governing bodies across the world have proposed certain standards which limit the overall power consumption of the display devices. Such power consumption standards may restrict the overall power consumption of the display device such that a maximum brightness value, measured in candelas per square meter (cd/m$^2$) or nits (nts), of a display device is reduced to ensure the display device complies with the power consumption standards.

While such regulations are effective at reducing the overall power consumption of a display device, such regulations may also negatively impact the display device capability to accurately reproduce visual content and may result in a negative user experience. For example, when a user purchases and turns on a display device for the first time, or after performing a factory reset of the display device, the user may be disappointed with the low brightness of the display device. In some applications, such as graphic design, video rendering, or the like where visual accuracy is particularly relevant, a low brightness display may impede the image quality and thus negatively impact the output of the user.

Accordingly, the present specification describes a display device with two separate modes. In a first mode, the brightness scale has a different range as compared to the brightness scale in a second mode. For example, in a power savings mode, the maximum brightness value may be capped so as to comply with a target power consumption level. In a performance mode, the maximum brightness value may not be capped so as to provide users with a brighter display device as desired. As a particular numeric example, when in the performance mode, a selected brightness setting of "100" may correspond to an absolute brightness value of 400 nits. When in the power savings mode, a selected brightness setting of "100" may correspond to an absolute brightness value of 150 nits. By limiting the brightness range for the default power savings mode, the display device may align with any target regulations. By offering consumers a full bright performance mode, the potential negative performance implications and negative user experience may be avoided.

In one particular example, in response to the display device being turned on for the first time or after the factory reset of the display device, the display device displays a message indicating that the current power mode of the display device is the power savings mode in which the brightness scale has a reduced maximum value. The display device then permits the user to change the current mode of the display device. For example, the user may change the current mode to a performance mode in which, when a particular brightness setting is selected, the display device is set to a higher brightness than were the display device in the power savings mode. That is, the selection between a power savings mode and a performance mode gives a user the option to select between a default low brightness mode with color presets capped in their maximum brightness output or the full brightness performance mode where color preset maximum brightness is not capped.

Such techniques may provide for a better user experience with the display device, may provide users with a power savings option as desired, and may also provide a performance mode wherein brightness is higher. Via the message and user interface, a user is reminded and given an opportunity to change the mode. The user, in other words, does not have to initiate reconfiguration of the display device's current mode, but rather the display device prompts the user as to whether he or she wishes to do so. Therefore, the user is less likely to be in a situation in which the display device is presenting visual content in a way that conflicts with the user's intent.

Specifically, the present specification describes a display device. The display device includes a display screen to display content. The display device has a first mode and a second mode. A first mode brightness scale is associated with a maximum brightness value that is different than a maximum brightness value for a second mode brightness scale. The brightness scales define a range of available brightness values for the screen for a respective mode. The display device also includes a display controller to select a brightness scale for the display device based on a mode of the display device.

The present specification also describes a method. According to the method, a first mode brightness scale that is associated with a first mode of the display device is identified and a second mode brightness scale that is associated with a second mode of the display device is identified. As described above, the brightness scales define a range of available brightness values for a screen of the display device in a respective mode. In this example, the second mode brightness scale has a higher a maximum brightness value than a maximum brightness value for the first mode brightness scale. A processor determines into which of a first mode and a second mode a display device is set and selects a brightness scale for the display device based on a selected mode.

The present specification also describes a non-transitory machine-readable storage medium encoded with instructions executable by a processor. The machine-readable storage medium includes instructions to 1) identify a first maximum brightness value for a display device when in a power savings mode and 2) identify a second maximum brightness value for the display device when in a performance mode, wherein the second maximum brightness value is greater than the first maximum brightness value. The instructions are also executable by the processor to 1) identify a first mode brightness scale associated with the power saving mode based on the first maximum brightness value and 2) identify a second mode brightness scale associated with the performance mode based on the second maximum brightness value. The brightness scales define a range of available brightness values for the display device in a respective mode and includes incremental brightness settings from a minimum brightness value to a respective maximum brightness value. The instructions are further executable to select a brightness scale for the display screen based on a selected mode.

Using such a display device, method, and machine-readable storage medium may, for example, 1) provide greater control over display device functionality and power settings; 2) comply with imposed power consumption regulations; 3) alleviate customer confusion upon first time viewing of a low brightness display screen; and 4) provide energy efficient modes and performance modes in a single display device. However, it is contemplated that the device, method, and machine-readable storage medium disclosed herein may address other matters and deficiencies in a number of technical areas, for example.

As used in the present specification and in the appended claims, the term, "controller" includes a processor and a memory device. The processor includes the circuitry to retrieve executable code from the memory and execute the executable code. As specific examples, the controller as described herein may include machine-readable storage medium, machine-readable storage medium and a processor, an application-specific integrated circuit (ASIC), a semiconductor-based microprocessor, and a field-programmable gate array (FPGA), and/or other hardware device.

As used in the present specification an in the appended claims, the term "memory" includes a non-transitory storage medium, which machine-readable storage medium may contain, or store machine-usable program code for use by or in connection with an instruction execution system, apparatus, or device. The memory may take many forms including volatile and non-volatile memory. For example, the memory may include Random-Access Memory (RAM), Read-Only Memory (ROM), optical memory disks, and magnetic disks, among others. The executable code may, when executed by the respective component, cause the component to implement the functionality described herein. The memory may include a single memory element or multiple memory elements.

As used in the present specification and in the appended claims, the term "brightness scale" refers to a scale from a minimum value to a maximum value where each setting along the scale corresponds to an associated brightness value. For example, the brightness scale may be from 0 to 100.

Further, as used in the present specification and in the appended claims, the term "brightness setting" refers to one of the incremental steps along the brightness scale. For example, the numeric values of 0, 1, 2, 3, . . . 98, 99, 100 may be brightness settings along the brightness scale. Each setting may be mapped to a corresponding brightness value.

Still further, as used in the present specification and in the appended claims, the term "brightness value" refers to an actual measure or setting of luminance or brightness of the display device. Brightness values may carry a unit of candela per square meter ($cd/m^2$) or nits (nts). A maximum brightness value is a brightness value associated with the maximum setting on the brightness scale. For example, on a scale of 0 to 100, a maximum setting of 100 may map to a brightness value of 400 nits, where 400 nits is the maximum brightness value. Similarly, each brightness setting along the brightness scale may map to a corresponding unique brightness value.

As used in the present specification and in the appended claims, the term "a number of" or similar language is meant to be understood broadly as any positive number including 1 to infinity.

Turning now to the figures, FIG. 1 is a diagram of a display device (100) with mode-based brightness scales (104), according to an example of the principles described herein. Note that while FIG. 1 depicts a display device (100) that is a computer screen of a computing device, as described above the display device (100) may be of a variety of types including a television, a tablet display screen, or a laptop computing device display screen, among others. As such, the display device (100) includes a display screen (102) to display content. The display screen (102) may be of a variety of types. For example, the display screen (102) may be a liquid crystal display (LCD), a light-emitting diode (LED) display, an organic LED (OLED), or a plasma display. While particular reference is made to particular types of display screens (102), the display device (100) may include any type of display screen (102).

As described above, the display device (100) may operate in a variety of modes. The display device (100) in a first mode is depicted above the dashed line while the display device (100) in the second mode is depicted below the dashed line. The difference between the modes is that the brightness scale (104) between the different modes is different. Specifically, the maximum brightness value associated with a maximum brightness setting is different between modes. That is, the brightness scale (104) defines the range of available brightness values for the display screen (102) while in the respective mode. The maximum brightness value associated with each brightness scale is different based on the mode of the display device (100).

That is, a display screen (102) may have an adjustable brightness such that the brightness of the display screen (102) may be altered. In some examples, the brightness may be referred to as luminance and may be measured as candela per square meter (cd/m$^2$) which may be referred to as a nit (nt). The brightness scale (104) is a scale from 0 to 100, with 0 mapping to a minimum brightness value, (which may be zero or some other minimum brightness value), while 100 maps to a maximum brightness value. As such, a user selecting a setting on the scale between 0-100, selects a corresponding brightness value for the display device (100).

Different brightness scales may have different brightness values associated with each incremental setting of the brightness scale. For example, as depicted in FIG. 1, according to the first mode brightness scale (104-1), at brightness setting 100, the brightness value may be 150 nits. However, according to the second mode brightness scale (104-2), at a brightness setting of 100, the brightness value may be 400 nits. As such, the available brightness values for the display screen (102) change based on the mode of the display device (100). Altering the maximum brightness value associated with each brightness scale (104) as such allows the display device (100) to offer one mode that conserves power while another mode provides a brighter display, which may be desired for some users or for some applications.

The maximum brightness value associated with the brightness scale (104) may be determined in a variety of ways and may differ from display device (100) to display device (100). Specifically, the maximum brightness values associated with the brightness scales (104) may be based on the hardware components and operating parameters of the display device (100). For example, as described above different display devices (100) may include different hardware components. As the hardware configuration determines the overall power consumption, any change to the hardware configuration changes the power consumption of the display device (100). Accordingly, different display devices (100) with different hardware components may reduce their brightness to different amounts to comply with power consumption regulations or target values.

As a particular example, a display device (100) that does not have as many hardware components may not consume as much power, and thus may be able to have a higher maximum brightness value and still fall under a target power consumption value. By comparison, a display device (100) that has more hardware components, such as a Bluetooth® or other wireless transceiver among other components, may have to reduce the higher maximum brightness value by a greater amount to fall under the same target power consumption value. As a particular numeric example, a first display device (100) may have a maximum brightness value of 400 nit and still fall under a target energy consumption threshold while a second display device (100) with more power-consuming hardware components may have to reduce its maximum brightness value to 200 nits to fall under the same target energy consumption threshold.

The display device (100) power consumption may be determined in a number of ways. In one example, the display device (100) may be attached to a power meter to measure the display device (100) overall power consumption. In an example where the target threshold is a governmental threshold such as the Energy using-products (EuP) threshold promulgated in Europe, energy star promulgated in North America, or a threshold set by any other regulating body, the procedures for measuring the overall power consumption may be set by the governing body. In this example, brightness is reduced until it complies with the target threshold. Table (1) below provides an example of the EuP Tier-2 thresholds that display devices (100) are to comply with.

TABLE 1

| | Display screens up to 2,138,400 pixels | Displays between 2,138,400 and 8,294,400 pixels | Displays above 8,294,400 pixels and micro-LED displays |
|---|---|---|---|
| EEI value | $EEI_{max} = 0.75$ | $EEI_{max} = 0.90$ | $EEI_{max} = 0.90$ |

In Table (1) above, the energy efficiency index (EEI) max refers to the energy efficiency of a display device (100) and may be calculated using Equation (1) provided below.

$$EEI = \frac{(P_{measured} + 1)}{(3 \times [90 \times \tanh(0.02 + 0.004 \times (A - 11)) + 4] + 3) + corr_{lum}} \quad \text{Equation (1)}$$

In Equation (1), A represents the viewing surface area in square decimeters (dm$^2$), $P_{measured}$ is the measured power in on mode in Watts in a default configuration, and $corr_{lum}$ is a correction factor set to zero.

While particular reference is made to a power meter attachment to the display device (100) to monitor overall power consumption and selecting a maximum brightness value based on the output of the power meter, other methods of determining power consumption and compliance therewith may be implemented in accordance with the principles described herein. Moreover, while particular reference is made to compliance with a governmental regulation, other target power consumption values may be implemented as described herein. Accordingly, the present specification describes a display device (100) that ensures compliance with a governmental, or other target, power consumption regulation.

However, as described above, the reduced brightness may negatively impact user experience and the display device's capability to accurately and satisfactorily present visual content. Accordingly, the first mode brightness scale (104-1) and the associated maximum brightness value may be selected to ensure that the brightness values for a particular display device (100) do not fall below a particular performance threshold.

Note that a display device (100) that complies with the power consumption target values while in one of the first mode and the second mode is said to comply with the power consumption regulation overall. Thus, the user is provided with a display device (100) that complies with a target power consumption value, such as a governmental regulation, while also providing a mode that while consuming more power, provides a brighter display for accurate and satisfactory content presentation.

In some examples, the display device (100) is placed in a default mode during shipping, which default mode may be a first mode where the maximum brightness value is set to align with a target or reduced power consumption level set either by a manufacturer or some governing body. That is, at time of manufacture and at factory reset, the display device (100) may be set in a power savings mode such that the maximum brightness value of the display device (100) is capped. The first time the display device (100) is turned on, the user may be provided with a prompt to receive selection of either continuing in the power savings mode or changing to a performance mode. Table (2) below provides an example of different modes as well as 1) the different brightness values associated with each color preset and 2) brightness settings associated with each brightness value.

TABLE 2

| Maximum Brightness | Performance Mode 300 | | Power Savings Mode 150 | |
|---|---|---|---|---|
| Value (cd/m2) Color Preset | Brightness values ($cd/m^2$) | Brightness setting | Brightness values ($cd/m^2$) | Brightness setting |
| sRGB | 240 + 20 | 76 | 120 + 20 | 70 |
| P3 | 240 + 20 | 76 | 120 + 20 | 70 |
| BT.709 | 100 + 20 | 20 | 100 + 20 | 50 |
| Warm (5000K) | 100 + 20 | 20 | 100 + 20 | 50 |
| Neutral (6504K) | 240 + 20 | 76 | 120 + 20 | 70 |
| Cool (7500K) | 180 + 20 | 52 | 90 + 20 | 40 |
| Native | >280 | 100 | >140 | 100 |

While Table (2) depicts various particular color presets, other color presets may be implemented in accordance with the principles described herein. As described above, color presets may include different settings to which the display device (100) is set, one such setting is a brightness value. For example, the sRGB color preset has a brightness setting along the second mode brightness scale (104-2) of 76, which corresponds to a brightness value of 240±20 $cd/m^2$. The same sRGB color preset has a brightness setting of 70 along the first mode brightness scale (104-2), which brightness setting of 70 corresponds to a brightness value of 120±20 $cd/m^2$. Accordingly, color presets for the display device (100) are assigned different brightness settings and brightness values in each of a first mode and a second mode, which first and second may be power savings and performance modes, respectively. Accordingly, when a particular color preset is selected, the display device (100), depending on its mode, is set to a corresponding brightness value as mapped above in Table (2). Note that while Table (2) depicts a particular mapping of color presets/brightness values to brightness settings, different mappings may exist and are contemplated by the present application.

In addition to adjusting the maximum brightness value, the dynamic contrast setting for the display device (100) may also be adjusted based on the selected mode of the display device (100). Contrast control blocks/allows incoming light. The light may still be there, but it is blocked from passing through the display screen (102). By comparison, brightness control changes the light emitting from the light source. Accordingly, a display controller (106) may block the amount of light allowed to pass through the display screen (102). The brightness of a display device (100) may be controlled in three ways, a brightness control, a contrast control, and red, green, blue (RGB) gain controls. The RGB gain value changes with the color preset and color standards so the brightness of the preset is tied to RGB levels and brightness. Some display devices determine the brightness based on RGB levels read from an incoming signal. For example, based on RGB values from the source signal, the display controller (106) adjusts real-time monitor contrast. The amount of adjustment of the contrast is gated by thresholds which determine when the monitor makes a large brightness change based on the level of the combined RGB incoming signal data. These thresholds may be tied to the maximum brightness value of the respective brightness scales (104). That is, the dynamic contrast thresholds may be set in a similar fashion as the brightness of the color presets for the display device (100). For example, the maximum contrast adjustment threshold, 255, may match the top brightness value (i.e., 400 nits or 150 nits).

As described above, the maximum brightness value may affect a dynamic/brightness for the display device (100). Dynamic contrast/brightness settings are settings that change the display screen (102) brightness based on detected screen content, for example using a real-time histogram.

The display device (100) further includes a display controller (106) to select a brightness scale (104) for the display device (100) based on a mode of the display device (100). As described above, the display controller (106) includes a processor and a memory device. The memory device includes executable code and data such as the mapping between modes and brightness scales and/or brightness scales and color preset brightness values. The processor of the display controller (106) may determine the mode of the display device (100), for example what is set as a default mode or based on received user input, and may select an appropriate brightness scale (104). Accordingly, responsive to user selection of a brightness setting along the brightness scale (104), the display controller (106) may alter the hardware components, such as the backlight, of the display device (100) such that the display device (100) has a brightness associated with the user selection.

Figure 2:
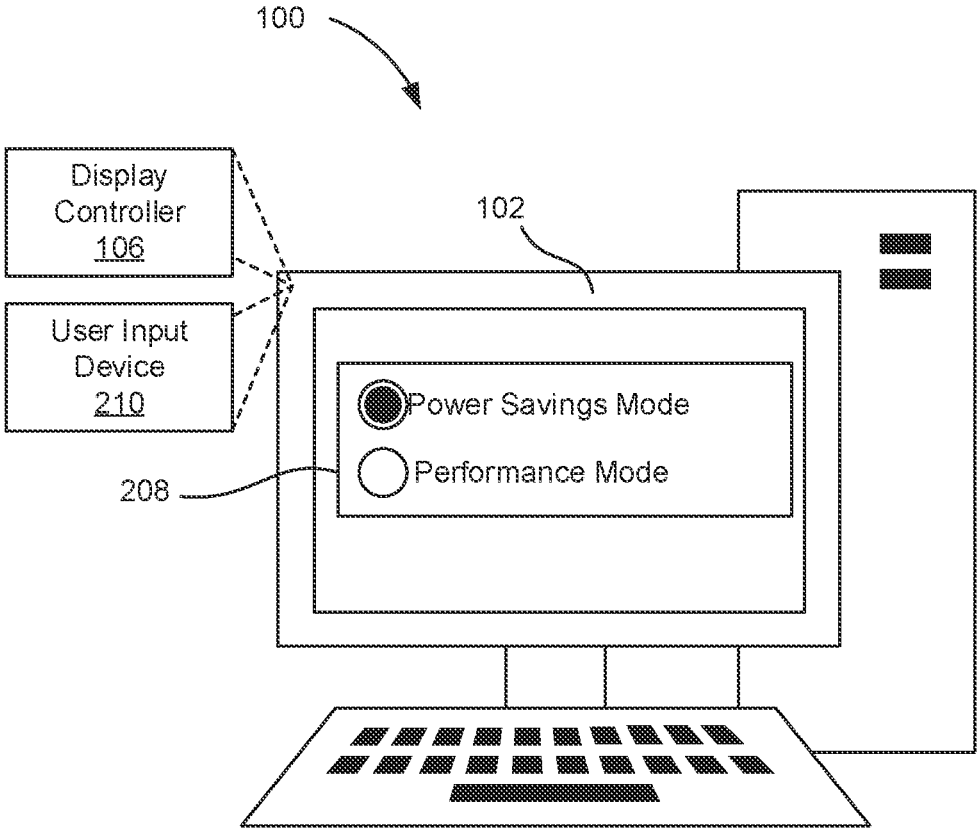
FIG. 2 is a diagram of a display device with mode-based brightness scales, according to an example of the principles described herein.

FIG. 2 is a diagram of a display device (100) with mode-based brightness scales (104), according to an example of the principles described herein. As described above following manufacture and shipping, an end-user receives the display device (100) in the default mode, which may be a power savings mode. When the display device (100) is turned on for the first time, or after factory reset, the display device (100) presents a user interface (208) to indicate that the current mode is a power savings mode. While FIG. 2 depicts a particular interface (208), different user interfaces (208) may be implemented in accordance with the principles described herein. For example, the user interface (208) may provide an explanation or message indicating the settings or function of the default power savings mode. For example, the user interface (208) may indicate that the performance mode, which may be the second mode, is an operating mode in which the display device (100) consumes more power than when in the power savings mode, which is the first mode.

As depicted in FIG. 2, the display device (100) may include a user input device (210) to trigger a mode switch for the display device (100). In the example depicted in FIG. 2, the user input device (210) is a radio button interface element to permit the user to make his or her desired selection. For instance, if the display screen (102) has touchscreen capability, the user may be able to tap the desired radio button. As another example, the user may use a human interface device (HID) such as a keyboard, mouse, or remote control to manipulate a cursor or otherwise navigate through the interface (208) to select the desired mode. As another example, the user input device (210) may be a physical button on the display screen (102) bezel through which a user can select a mode, or navigate through the interface (208) to select the desired mode.

Figure 3:
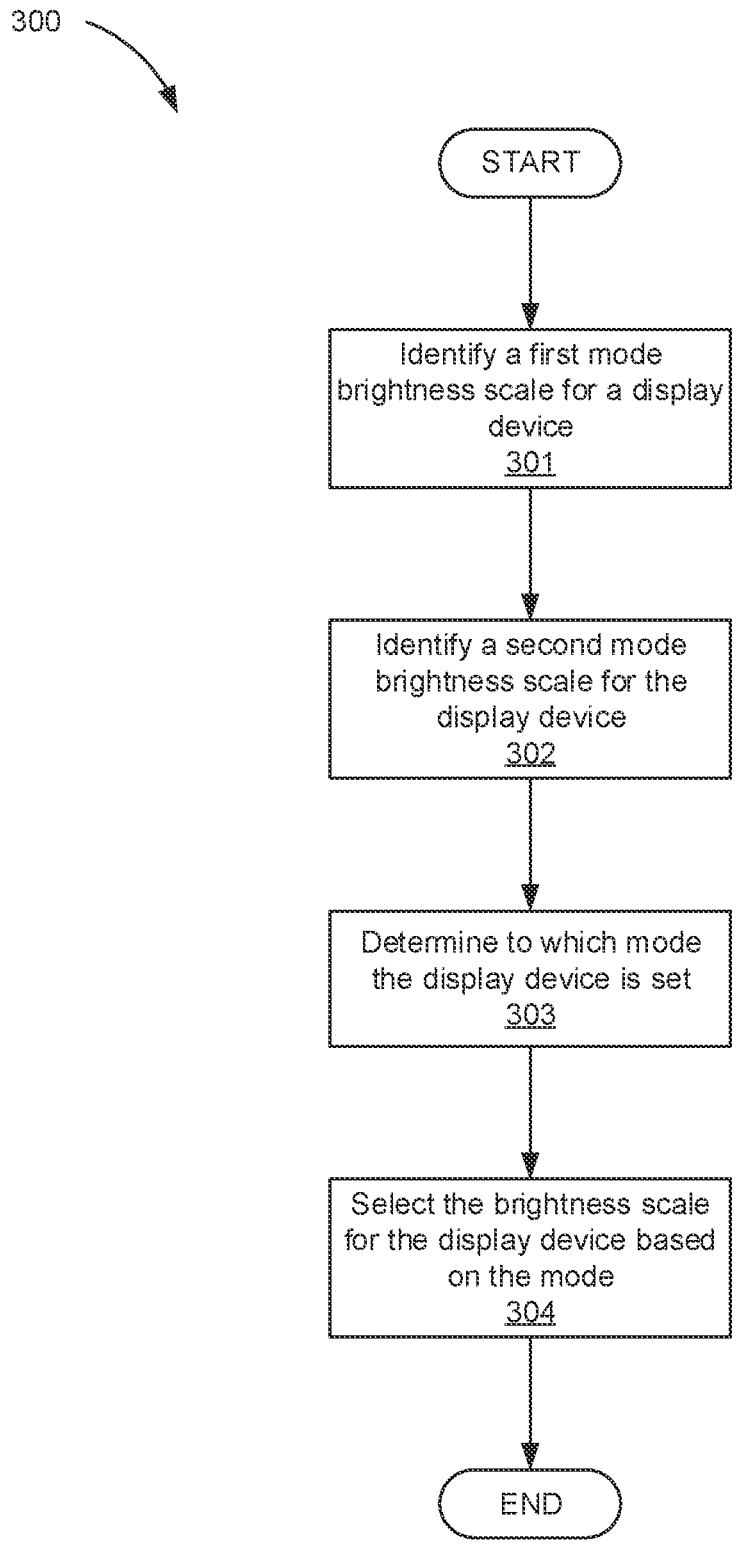
FIG. 3 is a flowchart of a method for selecting brightness scales based on display device mode, according to an example of the principles described herein.

FIG. 3 is a flowchart of a method (300) for selecting brightness scales (104) based on display device (100) mode, according to an example of the principles described herein. According to the method (300), a first mode brightness scale (104-1) associated with a first mode of a display device (100) is identified (block 301). As described above, this first mode may be a power savings mode wherein maximum brightness values associated with the first mode brightness scale (104-1) are capped so as to comply with a governmental established, or other target power consumption value. This maximum brightness value may be based on a number of factors including hardware components of the display device (100), a brightest color preset of the display device (100), and others.

The maximum brightness value associated with the first mode brightness scale (104-1) may be determined in a variety of ways. For example, as described above, a power meter may be coupled to the display device (100) to measure power consumption. In this example, the brightness of the display screen (102) may be reduced until the overall power consumption from the display device (100) falls under the government established, or other target, power consumption value. This maximum brightness value that is sub-threshold may be mapped to a maximum brightness setting on the first mode brightness scale (104-1). Accordingly, this first mode brightness scale (104-1) may be passed to the display controller (106), such that the display controller (106) may identify the first mode brightness scale (104-1).

Similarly, the display controller (106) may identify (block 302) a second mode brightness scale (104-2) associated with a second mode of the display device (100). The second mode may be a performance mode where the maximum brightness is not capped to comply with a power savings power consumption value, but is rather a higher value to increase brightness capability of the display screen (102). That is, the maximum brightness value associated with the "100" brightness setting on the second mode brightness scale (104-2) may be based on hardware components and not capped to comply with any government or other governing body-imposed standards. As such, identifying (block 301) the first mode brightness scale (104-1) and identifying (block 302) the second mode brightness scale (104-2) includes identifying maximum brightness values associated with a respective brightness scale (104). As the hardware components of the display device (100) plays a role in what the overall display device (100) power consumption and resultant maximum available brightness values, identifying the maximum brightness values and brightness scales may include identifying hardware components of the display device (100) upon which the first maximum brightness value (of the first mode brightness scale (104-1)) and the second maximum brightness value (of the second mode brightness scale (104-2)) are based.

The method (300) also includes determining (303) to which mode the display device (100) is set. That is, the display controller (106) may determine whether the display device (100) is in a first mode (e.g., a power savings mode) or a second mode (e.g., a performance mode). As described above, the default mode, or the mode in which the end user receives the display device (100), may be the power savings mode. Determining (block 303) the mode of the display device (100) may be performed by reading data from the display device (100). For example, the display device (100) may include a memory device that records save the state, or mode, of the display device (100). The display controller (106) may read a value from this memory device and thus determine (block 303) the mode of the display device (100). The display controller (106) may then select (block 304) a brightness scale (104) for the display device (100) based on a selected mode. For example, responsive to the display device (100) being in the first, or power savings, mode, the display controller (106) may select a first mode brightness scale (104-1) that has a maximum brightness value of 150 nt. By comparison, responsive to the display device (100) being in a second, or performance, mode, the display controller (106) may select a second mode brightness scale (104-2) that has a maximum brightness value of 400 nt.

Figure 4:
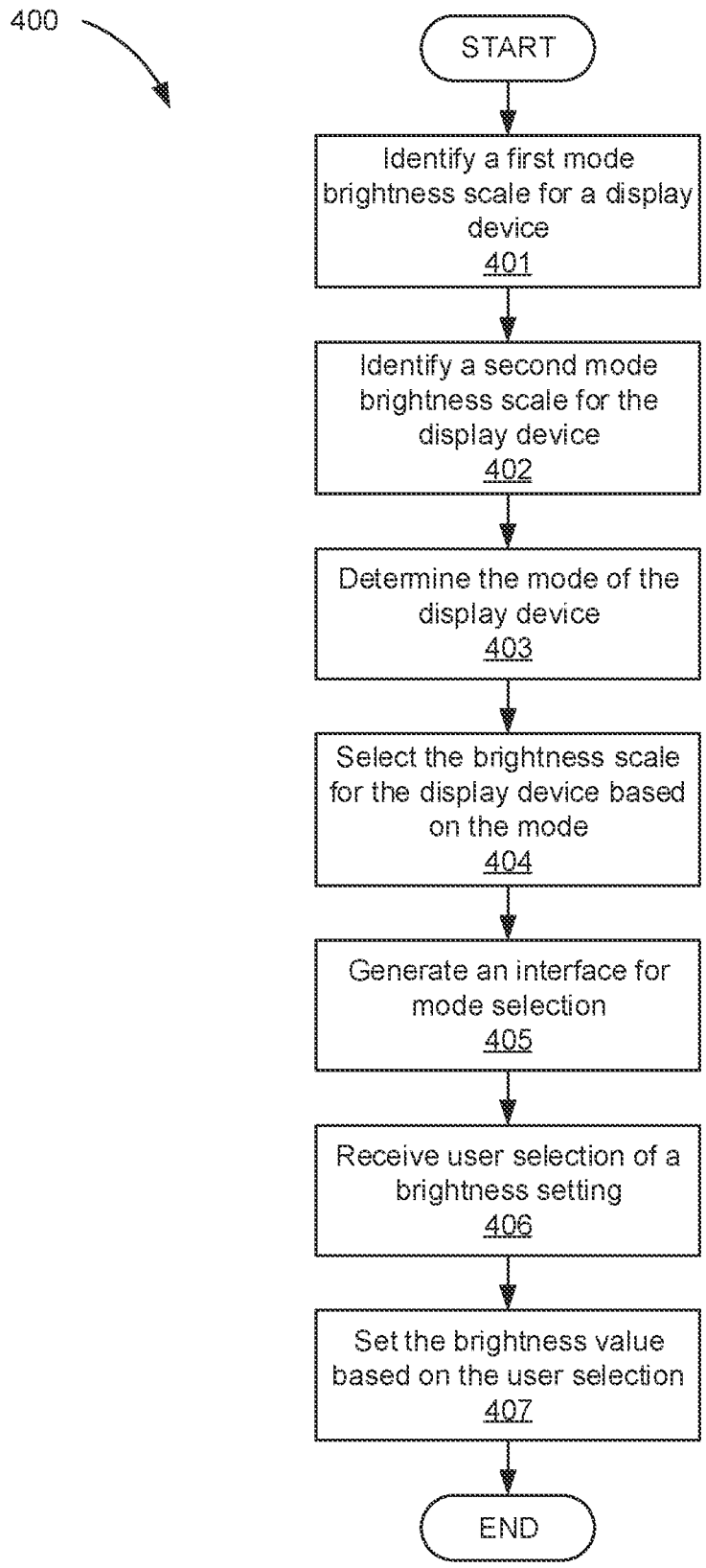
FIG. 4 is a flowchart of a method for selecting brightness scales based on display device mode, according to an example of the principles described herein.

FIG. 4 is a flowchart of a method (400) for selecting brightness scales (104) based on display device (100) mode, according to an example of the principles described herein. According to the method (400), a first mode brightness scale (104-1) for a display device (100) is identified (block 401) and a second mode brightness scale (104-2) for the display device (100) is identified (block 402). These operations may be performed as described above in connection with FIG. 3. According to the method (400), the display controller (106) determines (block 403) to which mode the display device (100) is set and selects (block 404) the brightness scale accordingly. These operations as well may be performed as described above in connection with FIG. 3.

As described above, responsive to the display device (100) being turned on for the first time, or after a factory reset of the display device (100), an interface (208) may be generated which 1) indicates the current default mode of the display device (100) which may be a power savings mode and 2) allows for user input to switch the mode of the display device (100). In other words, upon initialization of the display device (100), either for the first time or following a factory reset, the display controller (106) generates (block 405) an interface (208) to a user to select either the first mode or the second mode for the display device (100). That is, the display device (100) permits the user to change the current mode of the display device (100) from the power savings mode to the performance mode.

Displaying the interface (208) to indicate that the display device (100) is in the default mode when the display device (100) is powered on for the first time or after a factory reset reminds the user of the display settings of the display device (100) and that the display device (100) may present content different from what the user expects due to the energy-conserving brightness settings.

With the brightness scale (104) selected, the display controller (106) may receive (block 406) user selection of a brightness setting along the brightness scale (104). In an example, this may be via an interactive scale. For example, the brightness scale (104) may be presented as depicted in FIG. 1 such that a user may move a slider bar within the brightness scale (104) to select a particular incremental brightness setting. In another example, the user may enter the incremental brightness setting via a keyboard in a field of a user interface element.

In another example, the user may select a particular color preset. As described above, in addition to other display settings, each color preset may have a brightness value associated therewith. Accordingly, the user may indirectly select an incremental brightness setting, i.e., 0-100, based on the selection of a desired color preset.

In any example, the display controller (106) may set (block 407) the brightness value for the display device (100) based on the user selection and the brightness scale that is associated with the mode in which the display device (100) is currently operating in. For example, if the display device (100) is in a first mode with a maximum brightness value of 150 nit associated with the highest brightness setting, i.e., 100, and the user selects a brightness setting of 75, the display controller (106) may set the brightness value of the display device (100) to 112. By comparison, if the display device (100) is in a second mode with a maximum brightness value of 400 nit associated with the highest brightness setting, i.e., 100, and the user selects a brightness setting of 75, the display controller (106) may set the brightness value of the display device (100) to 300.

Figure 5:
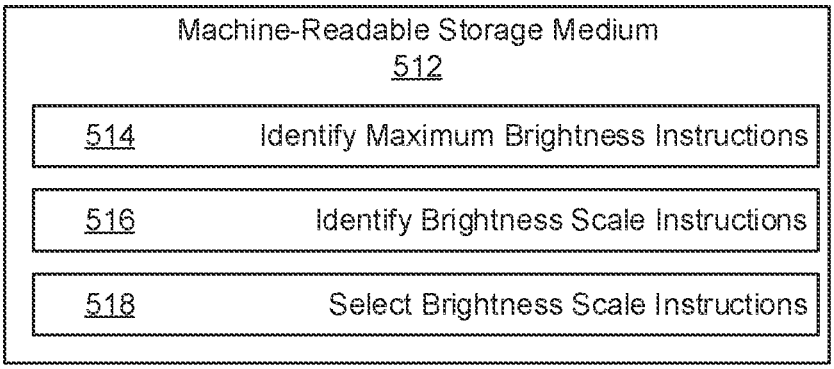
FIG. 5 depicts a non-transitory machine-readable storage medium for selecting brightness scales based on display device mode, according to an example of the principles described herein.

FIG. 5 depicts a non-transitory machine-readable storage medium (512) for selecting brightness scales (104) based on display device (100) mode, according to an example of the principles described herein. To achieve its desired functionality, the display controller (106) includes various hardware components. Specifically, the display controller (106) includes a processor and a machine-readable storage medium (512). The machine-readable storage medium (512) is communicatively coupled to the processor. The machine-readable storage medium (512) includes several instructions (514, 516, 518) for performing a designated function. In some examples, the instructions may be machine code and/or script code.

The machine-readable storage medium (512) causes the processor to execute the designated function of the instructions (514, 516, 518). The machine-readable storage medium (512) can store data, programs, instructions, or any other machine-readable data that can be utilized to operate the display controller (106). Machine-readable storage medium (512) can store machine-readable instructions that the processor of the display controller (106) can process, or execute. The machine-readable storage medium (512) can be an electronic, magnetic, optical, or other physical storage device that contains or stores executable instructions. Machine-readable storage medium (512) may be, for example, Random-Access Memory (RAM), an Electrically Erasable Programmable Read-Only Memory (EEPROM), a storage device, an optical disc, etc. The machine-readable storage medium (512) may be a non-transitory machine-readable storage medium (512).

Referring to FIG. 5, identify maximum brightness instructions (514), when executed by the processor, cause the processor to 1) identify a first maximum brightness value for a display device (100) when in a power savings mode and 2) identify a second maximum brightness value for the display device (100) when in a performance mode, wherein the second maximum brightness value is greater than the first maximum brightness value. Identify brightness scale instructions (516), when executed by the processor, cause the processor to, 1) identify a first mode brightness scale (104-1) associated with the power saving mode based on the first maximum brightness value and 2) identify a second mode brightness scale (104-2) associated with the performance mode based on the second maximum brightness value wherein the brightness scales include incremental brightness settings from zero to a respective maximum brightness value. Select brightness scale instructions (518), when executed by the processor, cause the processor to, select a brightness scale (104) for the display device (100) based on a selected mode.

Using such a display device, method, and machine-readable storage medium may, for example, 1) provide greater control over display device functionality and power settings; 2) comply with imposed power consumption regulations; 3) alleviate customer confusion upon first time viewing of a low brightness display screen; and 4) provide energy efficient modes and performance modes in a single display device. However, it is contemplated that the device, method, and machine-readable storage medium disclosed herein may address other matters and deficiencies in a number of technical areas, for example.

What is claimed is:

1. A display device, comprising:

a display screen to display content, wherein:

the display device has a first mode and a second mode;

a first mode brightness scale is associated with a first maximum brightness value that is different than a second maximum brightness value for a second mode brightness scale;

the brightness scales each define a range of available brightness values for the display screen for a respective mode; and the brightness scales define the same relative range from a minimum setting to a maximum setting such that the maximum setting is associated with the first maximum brightness value in the first mode brightness scale and the maximum setting is associated with the second maximum brightness value in the second mode brightness scale; and a display controller to select a brightness scale for the display device based on a mode of the display device.

2. The display device of claim 1, wherein the display device is placed in a default mode during shipping, which default mode is the first mode.

3. The display device of claim 1, wherein:

the first mode is a power savings mode;

the second mode is a performance mode; and the display device is to consume more power when in the second mode relative to the first mode.

4. The display device of claim 1, further comprising a user input device to trigger a switch of mode of the display device.

5. The display device of claim 1, wherein the first maximum brightness value of the first mode brightness scale is defined by a brightest color preset.

6. The display device of claim 5, wherein the first maximum brightness value of the first mode brightness scale is such that the display device is not below a particular performance threshold.

7. The display device of claim 1, wherein different color presets for the display screen are assigned different brightness scale settings in each of the first mode and the second mode.

8. A method, comprising:

identifying a first mode brightness scale associated with a first mode of a display device;

identifying a second mode brightness scale associated with a second mode of the display device, wherein:

the brightness scales define a range of available brightness values for the display device in a respective mode; and the second mode brightness scale has a higher, second maximum brightness value than a first maximum brightness value for the first mode brightness scale, and the brightness scales define the same relative range from a minimum setting to a maximum setting such that the maximum setting is associated with the first maximum brightness value in the first mode brightness scale and the maximum setting is associated with the second maximum brightness value in the second mode brightness scale;

determining to which of a first mode and a second mode the display device is set; and selecting a brightness scale for the display device based on a selected mode.

9. The method of claim 8, further comprising, upon initialization of the display device, generating an interface to prompt a user to select either the first mode or the second mode for the display device.

10. The method of claim 8, wherein the maximum brightness values of the brightness scales are based on hardware components and operating parameters of the display device.

11. The method of claim 8, further comprising:

receiving user selection of an incremental setting along the brightness scale; and setting the brightness of the display device based on the user selection and a brightness scale associated with a current mode of the display device.

12. The method of claim 8, wherein identifying the first mode brightness scale and the second mode brightness scale comprises identifying a maximum brightness value associated with a respective brightness scale.

13. The method of claim 8, further comprising adjusting a dynamic contrast/brightness setting for the display device based on wherein the first maximum brightness value on the first mode brightness scale is selected based on a dynamic contrast/brightness setting for the display device based on the selected mode.

14. A non-transitory machine-readable storage medium encoded with instructions executable by a processor, the machine-readable storage medium comprising instructions to:

identify a first maximum brightness value for a display device when in a power saving mode;

identify a second maximum brightness value for the display device when in a performance mode, wherein the second maximum brightness value is greater than the first maximum brightness value;

identify a first mode brightness scale associated with the power saving mode based on the first maximum brightness value;

identify a second mode brightness scale associated with the performance mode based on the second maximum brightness value, wherein:

the brightness scales define a range of available brightness values for the display device in a respective mode;

the brightness scales comprise incremental brightness settings from zero to a maximum setting that maps to a respective maximum brightness value such that the maximum setting is associated with the first maximum brightness value in the first mode brightness scale and the maximum setting is associated with the second maximum brightness value in the second mode brightness scale; and select a brightness scale for the display device based on a selected mode.

15. The non-transitory machine-readable storage medium of claim 14, further comprising instructions executable by a processor, to identify hardware components of the display device upon which the first maximum brightness value and second maximum brightness value are based.

* * * * *